United States Patent [19]

Hay, deceased et al.

[11] 4,080,586

[45] Mar. 21, 1978

[54] THERMAL SWITCH HAVING MOVABLE INSULATIVE MEMBER THEREIN

[75] Inventors: Warren H. Hay, deceased, late of South Hamilton, Mass., by Jean F. Hay, executor; Carl V. Joslin, executor, Beverley; Paul E. Gates, Canvers, both of Mass.

[73] Assignee: GTE Sylvania Incorporated, Stamford, Mass.

[21] Appl. No.: 822,405

[22] Filed: Aug. 8, 1977

[51] Int. Cl.[2] ..... H01H 37/76

[52] U.S. Cl. ..... 337/407; 337/409

[58] Field of Search ..... 337/407, 408, 409

[56] References Cited

U.S. PATENT DOCUMENTS

| | | | |
|---|---|---|---|
| 3,291,945 | 12/1966 | Merrill et al. | 337/407 X |
| 3,952,274 | 4/1976 | Plasko | 337/408 X |
| 3,956,725 | 5/1976 | Merrill et al. | 337/409 X |

*Primary Examiner*—George Harris

*Attorney, Agent, or Firm*—Lawrence R. Fraley

[57] ABSTRACT

A thermally responsive electric switch which has an insulative member movably oriented within the switch's housing. A conductive element is positioned within the movable member to electrically interconnect the spaced end portions of two lead-in wires also positioned within the housing. A thin layer of fusible material (e.g. gallium) is positioned on the ends of the lead-in wires and in contact with the conductive element when the movable member occupies a first position within the housing.

10 Claims, 3 Drawing Figures

THERMAL SWITCH HAVING MOVABLE INSULATIVE MEMBER THEREIN

BACKGROUND OF THE INVENTION

This invention relates to thermal electrical switches and particularly to such switches which provide an open circuit when heated to an established temperature. As will be defined, the invention also relates to switches of the variety described wherein the opened switch is not resettable.

It is known in the art to employ non-resettable, thermally responsive electric switches within such electrical appliances as toasters, frying pans, coffee pots, etc. The function of these switches is to prevent overheating of the appliance, which can prove extremely hazardous to the respective operator. Accordingly, it is desired in the industry to provide a thermal switch which combines the features of being reliable and operable with a minimum of electrical resistance when positioned within the respective appliance circuitry. Because these members must be replaced after satisfying the needed function, it is further desirous to provide such a switch which is both relatively inexpensive and easy to manufacture. It is even further desirous to provide a switch having all of the above features and yet still lends itself to miniaturization. The switches of the known prior art have proven incapable of combining all of these features.

It is believed therefore that a thermal electric switch which possesses all of the aforementioned features would constitute an advancement in the art.

OBJECTS AND SUMMARY OF THE INVENTION

It is a primary object of the present invention to enhance the thermal switching art by providing a switch which combines the above desired features.

In accordance with one aspect of the invention, there is provided a thermally responsive, non-resettable switch which comprises a housing defining a chamber therein, a movable insulative member within the chamber, a conductive element within the movable member which electrically interconnects the end portions of two spacedly positioned lead-in wires within the housing when the movable member occupies a first position within the chamber, and a thin layer of fusible material on each end of the lead-in wires and in contact with the conductive element when the movable member occupies the first position.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
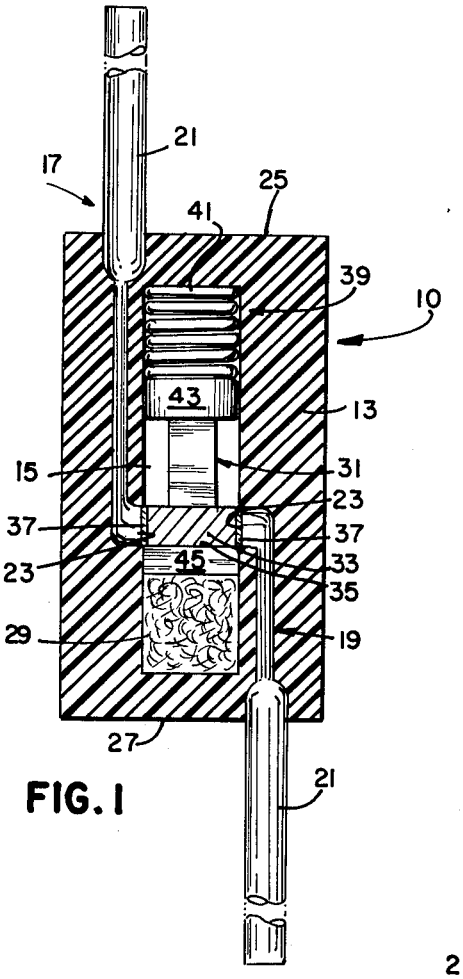
FIGS. 1–3 represent plan views, partly in section, of thermally responsive, non-resettable switches in accordance with various embodiments of the invention.

In FIG. 1 there is shown a thermally responsive, non-resettable electric switch 10 in accordance with one of the preferred embodiments of the invention. Switch 10 comprises an electrically insulative (e.g. plastic or glass) housing 13 which defines therein an elongated channel 15 which preferably is rectangular in cross-section and runs lengthwise of the longitudinal housing. First and second lead-in wires 17 and 19, respectively, are spacedly oriented within housing 13 and each include a first end portion 21 which projects from housing 13 and a second end portion 23 which has access to channel 15. In the embodiment of FIG. 1, first ends 21 project from opposing ends 25 and 27 of housing 13.

A meltable pellet 29 is positioned within channel 15. The pellet, preferably of boxlike configuration, is designed to collapse at a specified temperature (e.g. within a range of about 70° C to 180° C) and may be of any of the well known fuse materials capable of providing this function. Positioned against pellet 29 is an electrically insulative (e.g. plastic) movable member 31 which is capable of occupying a first, operating position (FIG. 1) and a second, open position within channel 15. Member 31 moves to the second position to open contact between second end portions 23 only when pellet 29 collapses at the above specified temperature. Electrical contact between ends 23 while switch 10 is in the first (operating) position is established through a conductive element 33. Element 33, preferably copper, is positioned within an aperture 35 located within member 31.

To enhance the connection between ends 23 during the switch's operating or "on" condition of FIG. 1, a thin layer 37 of electrically conductive fusible material is located on each end 23. Each layer 37 is further in contact with the opposing ends of element 33. In accordance with the preferred embodiment of the invention, this fusible material is gallium. Gallium is preferred because it has a melting point of about 30° C, is easily wettable to ends 23 and element 33, and is in a softened condition at normal ambient temperatures of about 21° C. The material in this condition thus assures a resilient type of interface between ends 23 and element 33 to reduce the opportunity for an open circuit when switch 10 is subjected to physical shock. Gallium, when used in layers of thickness to be described, also assures a low electrical resistance and a low surface tension at these junctures. The latter feature is considered highly significant and substantially enhances the operability of switch 10. Prior art switches which employed fusible links in other forms were unable to eliminate high surface tension at the contacting surfaces and thus reduce the opportunity for failure. On many occasions, the fusible material of the prior art switches tended to bridge the contacts after melting, thereby failing to open the circuit.

Switch 10 further includes a biasing means 39 located within channel 15 for continuously biasing member 31 against pellet 29. Means 39 is preferably a helical spring 41. Accordingly, it is preferred to provide member 31 with a cylindrical first end 43 for abutting spring 41 and a boxlike second end 45 for engaging the correspondingly boxlike pellet 29. As shown, aperture 35 is located within second end 45 and extends therethrough.

In normal operation, a fusible material on ends 23 is in a fluid state and readily fills any voids between ends 23 and the respective ends of element 33. Should the ambient about switch 10 rise to a temperature representative of an overheated condition, pellet 29 collapses (or melts) and member 31 is forced toward the pellet by spring 41. Accordingly, element 33 becomes disengaged from ends 23 to assure an open circuit therebetween. As a further feature of the invention, the meltable pellet 29 is preferably of electrically insulative material and is designed to move within channel 15 while in its melted state and pass across ends 23. This assures an insulative barrier across the ends 23 to prevent subsequent arcing between these members and the conductive element.

Figure 2:
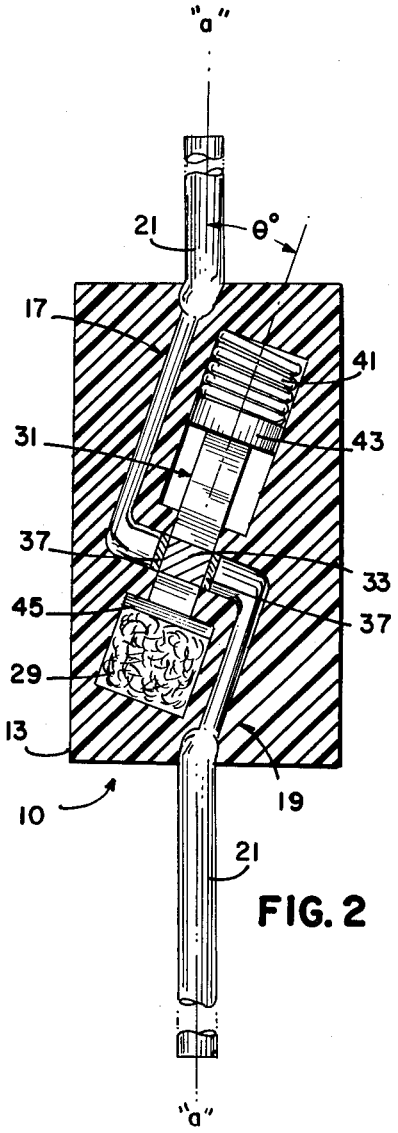

In FIG. 2, channel 15 is angularly oriented (angle $\theta$) with respect to the longitudinal axis "*a—a*" of housing 13 such that first ends 21 project from opposing ends of the housing and lie on axis "*a—a*". This in-line positioning relationship may be preferred to accommodate a specific circuit in which switch 10 is positioned. Understandably, angularly displacing channel 15 similarly displaces the direction of movement of member 31 therein. Angle $\theta$ is preferably within the range of about 10° to 30°.

Figure 3:
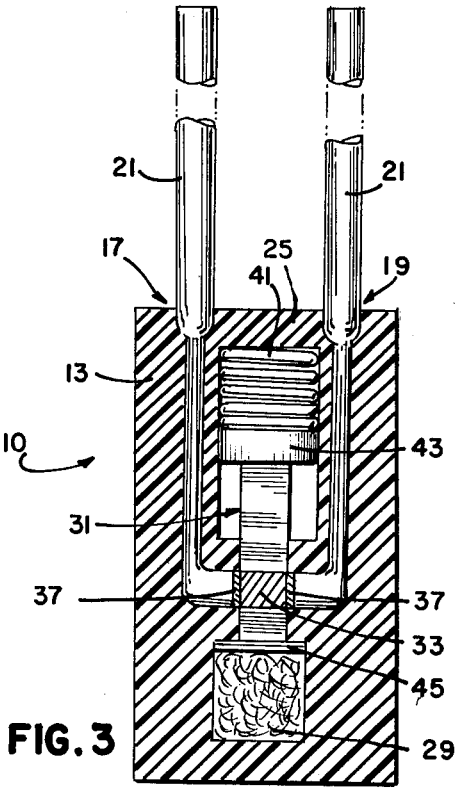

In the embodiment of FIG. 3, first ends 21 project from one side 25 of housing 13. This relationship may also be desired to accommodate still another circuit arrangement.

As stated, the preferred material for housing 13 and movable member 31 is plastic. It is also preferred to employ a teflon-impregnated plastic as this material. With further regard to the invention, the melting point of the fusible gallium material interconnecting ends 23 of the lead-in wires and element 33 is lower than the melting point of meltable pellet 29.

One of the significant features of the invention is the ability of switch 10 to lend itself to miniaturization. As an example, successful operating switches have been produced in which housing 13 has typical dimensions of about 7 mm. (width) × 13 mm. (length). Additionally, movable member is about 7 mm. long and the cylindrical first end 43 has a diameter of 2.5 mm. Wires 17 have a typical diameter of 1.01 mm. while element 33, which is preferably cylindrical, has a diameter of 1.2 mm. and a length of 2.5 mm. Also, each layer 37 of gallium has a thickness within the range of about 0.0508 to 0.127 mm.

Thus there thas been shown and described a thermal switch which is inexpensive and easy to manufacture, highly reliable, utilizes a minimum of components, and which readily lends itself to miniaturization.

While there have been shown and described what are at present considered the preferred embodiments of the invention, it will be obvious to those skilled in the art that various changes and modifications may be made therein without departing from the scope of the invention as defined by the appended claims.

What is claimed is:

1. A thermally responsive, non-resettable electric switch comprising:

an electrically insulative housing defining an elongated chamber therein;

first and second lead-in wires spacedly positioned within said housing, each of said lead-in wires including a first end portion projecting from said housing and a second end portion having access to said elongated chamber;

a meltable pellet positioned within said elongated chamber;

an electrically insulative movable member positioned within said elongated chamber against said meltable pellet, said movable member moving from a first position to a second position in response to collapse of said meltable pellet;

means for biasing said movable member against said meltable pellet;

an electrically conductive element within said movable member for electrically interconnecting said second end portions of said lead-in wires only when said movable member occupies said first position; and a thin layer of electrically conductive fusible material located on each of said second end portions of said spacedly positioned lead-in wires and in contact with said conductive element when said movable member occupies said first position.

2. The thermally responsive switch according to claim 1 wherein said first end portions of said first and second lead-in wires project from one side of said housing.

3. The thermally responsive switch according to claim 1 wherein said first end portions of said first and second lead-in wires project from opposing ends of said housing.

4. The thermally responsive switch according to claim 3 wherein said projecting first end portions occupy a common axis, said movable member moving in a direction within said chamber at a predetermined angle with said common axis.

5. The thermally responsive switch according to claim 4 wherein said predetermined angle is within the range of from about 10° to about 30°.

6. The thermally responsive switch according to claim 1 wherein said movable member includes a substantially cylindrical first end portion in engagement with said biasing means and a boxlike second end portion positioned against said meltable pellet.

7. The thermally responsive switch according to claim 6 wherein said boxlike second end portion of said movable member includes an aperture therein, said conductive element located within said aperture.

8. The thermally responsive switch according to claim 6 wherein said biasing means comprises a helical spring.

9. The thermally responsive switch according to claim 1 wherein said conductive fusible material has a melting point less than the melting point of said meltable pellet.

10. The thermally responsive switch according to claim 9 wherein said fusible material is gallium.

* * * * *